US008740686B2

(12) United States Patent
Khal

(10) Patent No.: US 8,740,686 B2
(45) Date of Patent: Jun. 3, 2014

(54) PRIMARY OR SECONDARY MULTI-WIN BINGO WAGERING SYSTEM AND METHOD

(76) Inventor: Zak Khal, Las Vegas, NV (US)

( * ) Notice: Subject to any disclaimer, the term of this patent is extended or adjusted under 35 U.S.C. 154(b) by 713 days.

(21) Appl. No.: 12/862,304

(22) Filed: Aug. 24, 2010

(65) Prior Publication Data

US 2011/0045889 A1 Feb. 24, 2011

Related U.S. Application Data

(60) Provisional application No. 61/236,352, filed on Aug. 24, 2009.

(51) Int. Cl.
*A63F 3/06* (2006.01)

(52) U.S. Cl.
USPC ..... 463/18; 463/19

(58) Field of Classification Search
USPC ..... 463/16, 17, 18, 19
See application file for complete search history.

(56) References Cited

U.S. PATENT DOCUMENTS

| | | | | |
|---|---|---|---|---|
| 5,338,042 | A | 8/1994 | Greer | |
| 5,727,786 | A | 3/1998 | Weingardt | |
| 5,788,237 | A | 8/1998 | Fults et al. | |
| 6,565,091 | B2 | 5/2003 | Weingardt | |
| 6,581,935 | B1 * | 6/2003 | Odom | 273/269 |
| 6,652,378 | B2 | 11/2003 | Cannon et al. | |
| 6,698,755 | B2 | 3/2004 | Cherry | |
| 6,722,975 | B2 | 4/2004 | Duhamel | |
| 6,780,108 | B1 | 8/2004 | Luciano, Jr. et al. | |
| 6,832,956 | B1 | 12/2004 | Boyd et al. | |
| 6,860,810 | B2 | 3/2005 | Cannon et al. | |
| 7,186,180 | B2 | 3/2007 | Lathrop et al. | |
| 7,204,756 | B2 | 4/2007 | Jubinville et al. | |
| 7,217,188 | B2 | 5/2007 | Byrne | |
| 7,270,604 | B2 | 9/2007 | Gerrard et al. | |
| 7,452,270 | B2 | 11/2008 | Walker et al. | |
| 7,481,707 | B1 | 1/2009 | Luciano, Jr. et al. | |
| 7,494,413 | B2 | 2/2009 | Singer et al. | |
| 7,500,913 | B2 | 3/2009 | Baerlocher | |
| 7,500,914 | B2 | 3/2009 | Rodgers et al. | |
| 2003/0013516 | A1 * | 1/2003 | Walker et al. | 463/25 |
| 2004/0152505 | A1 * | 8/2004 | Herrmann et al. | 463/16 |
| 2004/0152508 | A1 * | 8/2004 | Lind et al. | 463/19 |
| 2005/0059471 | A1 * | 3/2005 | Cannon | 463/19 |
| 2005/0161881 | A1 * | 7/2005 | Blaklev et al. | 273/269 |
| 2008/0188279 | A1 * | 8/2008 | Seelig et al. | 463/19 |
| 2008/0261683 | A1 * | 10/2008 | Russell et al. | 463/26 |

* cited by examiner

*Primary Examiner* — Damon Pierce
(74) *Attorney, Agent, or Firm* — Brooks Kushman P.C.

(57) ABSTRACT

A system and method for playing a game of chance, either as a primary or secondary game offering, having a first winning criterion associated with matching player indicia on a player card to house indicia selected or otherwise determined by operator calls include awarding a first prize for every player card that satisfies the winning criterion after each operator call less than or equal to a first number of operator calls and awarding a subsequent prize for every player card that satisfies the same winning criterion after each call up to and including a second number of operator calls and continuing the game until at least all calls up to and including the second number of calls have been made.

75 Claims, 2 Drawing Sheets

| Ball Calls | | Prize |
|---|---|---|
| 48 | or less | 100,000 |
| 49 | exactly | 50,000 |
| 50 | exactly | 25,000 |
| 51 | exactly | 10,000 |
| 52 | exactly | 5,000 |
| 53 | exactly | 4,000 |
| 54 | exactly | 3,000 |
| 55 | exactly | 2,000 |

PRIMARY OR SECONDARY MULTI-WIN BINGO WAGERING SYSTEM AND METHOD

CROSS-REFERENCE TO RELATED APPLICATION

This application claims the benefit of U.S. Provisional Application Ser. No. 61/236,352 filed Aug. 24, 2009 titled "Bingo Game With Multiple Prizes And Winners", and is related to commonly owned and copending U.S. App. Ser. No. 12/862,318, filed Aug. 24, 2010 and titled "Multi-Win Bingo Gaming System And Method", the disclosures of which are hereby incorporated by reference in their entirety.

BACKGROUND

1. Field

Embodiments of the present disclosure relate to a gaming system and method for playing bingo and related games with multiple prizes and/or winners.

2. Background

Bingo is a game of chance played with randomly drawn articles typically having numbers that players match against numbers often pre-arranged in a table, grid, matrix, or array, generally referred to as faces, to make a predetermined winning pattern. The numbers may be printed on paper or cardstock, or electronically represented on a display with the subset of numbers for each play generally referred to as cards or tickets. When a single paper or other playing piece includes multiple cards, each may be referred to as a card face with the group of card faces referred to as a card or ticket. Players try to obtain the winning pattern or number of matches on their faces by covering or marking numbers on their cards as numbers are randomly selected from a predetermined group of numbers, such as 75 or 90 numbers, for example. Once a winning pattern or number is achieved, the game ends. There is no minimum number of selected numbers required to end the game beyond the minimum number of calls necessary to complete the pattern or number in the winning criterion.

Traditional bingo and related games generally conclude the game when the first person achieves a specified winning pattern using the randomly selected or called numbers. The winner is usually required to call out the word "Bingo!" which alerts the other players and game supervisor or caller of a possible winner. Wins are generally checked for accuracy before the win is officially confirmed at which time the prize is secured and a new game is begun. In computerized systems, a win may be confirmed or validated by a computer using a security code or other identifier contained on each card. In this version of bingo, players compete against one another for the prize or jackpot.

Although regulations for bingo and related games vary considerably by jurisdiction, the regulations generally include some requirement that the game must be played to conclusion. This requirement is generally interpreted as requiring a winner or winners. As such, if there are no winners in the prescribed number of calls, players continue to play for a consolation prize. The operator continues to draw balls until someone achieves the winning combination. The consolation prize paid to the next player that achieves the winning pattern or combination. As the number of balls called approaches the total number of available balls, there will inevitably be a winner.

Consolation prizes may be a fixed amount or a pari-mutuel prize based on the total or aggregate number and price of cards or tickets purchased by all players for that game. Payment of consolation prizes may be a significant operating expense for bingo gaming establishments. In addition, because of the uncertainty in the number of calls that may be required for a consolation prize winner, the use of consolation prizes to meet the requirement that the game be played to conclusion may reduce the total number of games that can be played in a given time period and thereby adversely affect scheduling of games and overall revenue for the operator.

Alternative methods of play have been developed to increase participation by creating excitement. Since its invention in 1934, modern bingo has evolved into multiple variations, with each jurisdiction's gambling laws regulating how the game is played. There are also nearly unlimited patterns that may be specified for play. Some patterns only require one number to be matched whereas cover-all games require an entire card to be matched or covered to award the jackpot. Other games may award prizes to players for matching no numbers or achieving none of the specified patterns.

There are many variations of bingo games and even bingo cards. For example, double-action cards have two numbers in each square. However, the most common bingo cards are flat pieces of cardboard or disposable paper that contain 25 squares arranged in five vertical columns and five horizontal rows. Each space in the grid contains a single number, except there may be one or more "Free" spaces, which typically include at least the center space. The "Free" spaces are considered covered or filled from the beginning of the game. For games played utilizing 75 numbers or another multiple of 5 numbers, the letters B, I, N, G, O may be pre-printed above the five vertical columns with one letter appearing above each column to assist players in more quickly locating a called number on their card(s). Players often play multiple cards for each game. For 75 number games, the numbers printed on the card are commonly arranged as follows: 1 to 15 in the B column; 16 to 30 in the I column; 31 to 45 in the N column; 46 to 60 in the G column and 61 to 75 in the 0 column. Depending on how many numbers are in each column for a particular game, the numbers are generally randomly selected from the number ranges above for each column. For example, a standard bingo game may include 25 spaces with 5 randomly selected numbers between 1 and 15 assigned to the B column, and so on. However, one variation randomly assigns the numbers to the available columns. In another variation, sometimes referred to as "U-Pick'Em" bingo, players may be issued three cards each having ⅓ of the total available numbers with all numbers that may be called or drawn included. Players then identify or mark which numbers they wish to play and then cover or mark the selected numbers when a corresponding number is called or drawn. Rather than a predetermined pattern, a predetermined number (such as 5 or 10) of matches to the called numbers determines a winning card.

Various patterns may be used to determine a winner for a particular game. In addition to a straight horizontal, vertical, or diagonal line, many bingo halls consider other patterns as a valid bingo, usually in special games. For example, a 2×2 square in the upper right-hand corner would be considered a "postage stamp". Another common special game requires players to cover each of the four corner squares. Games may also require two lines (double) or three lines (triple) to win. Combination games may have multiple bingos and/or winners based on different winning patterns or criteria. For example, the players first play to achieve a first winning pattern, such as a single line, to determine a first winner and then continue playing with the same cards and numbers to achieve a second winning pattern, such as a double line or coverall for a another prize.

The called numbers may be randomly selected using various methods for any of the variations of the game. With the expansion of computer technology, electronic random number generators are now commonplace in many jurisdictions. However, some jurisdictions require mechanical ball draws that may utilize a randomly shuffled deck of bingo calling cards, a mechanical ball blower that mixes ping-pong balls with blown air, or a cage that is turned to mix small wooden balls. All methods essentially generate a random string of numbers for players to match to their bingo cards.

In another version of play sometimes referred to as "Quick Shot", numbers are pre-drawn and players purchase sealed bingo cards that are then matched against the pre-drawn numbers. If a specified pattern is achieved, then the player usually wins a prize according to a prize table. Some versions are played until a player achieves a top level prize, and then new numbers are drawn and the game begins anew. This type of bingo may be played over days, weeks, or months depending on the difficulty of achieving a top level prize.

In "Bonanza Bingo" played with 75 numbers, typically 43 numbers are pre-drawn at the beginning of a bingo session. Players purchase sealed cards that are then matched against the pre-drawn numbers. At a designated time, the caller asks if anyone has a winning pattern or bingo. If no winners are identified, the caller then draws one more ball. This game is commonly played as a "progressive" game, where the jackpot increases as more cards are sold. If no one has achieved bingo after the single ball has been drawn, players then hold their cards for the next session of bingo, which may take, place the following day or following week. During each session thereafter, a single ball is drawn and players may continue to purchase additional sealed cards until someone achieves a cover-all. This version of bingo awards prizes to players who do not have a single number matched from the initial numbers drawn.

Many bingo gaming establishments have a call board or flashboard with called numbers illuminated for the players to see previously called numbers. In U.S. style bingo using 75 numbers, the flashboard is often arranged in 5 rows of 15 columns with the numbers arranged in sequence from left to right. In a version referred to as "Horse Racing Bingo" up to 15 players are randomly issued a number from 1 to 15 corresponding to the top row of numbers on the flashboard. Numbers are then drawn and the first person to match all five numbers in their assigned column wins. This is a fast paced and exciting form of bingo typically played in fraternal organizations.

With the expansion of Tribal gaming across the U.S., there are numerous versions of bingo that emulate the fast action of casino like table games, but utilize the principals of bingo where players mark and monitor grid or matrix cards with chips. Casino games like Roulette, Acey Duecy, and Money Wheel have bingo counterparts, which are permitted to be played under bingo licenses in many parts of the country.

There are several differences between European (or U.K.) style bingo and U.S. style bingo, including the cards, pool of numbers, and winning combinations, for example. European style bingo is generally played by selecting numbers from a group of 90 articles or elements that are numbered from 1 to 90, rather than the 75 numbers used in U.S. style bingo. A typical bingo ticket or card is arranged in a grid having nine columns and three rows. Rather than having a number in each square of the grid, each row contains five numbers and four blank spaces. The numbers and blank spaces are arranged so that each column contains at least one number. The numbers are generally assigned with the first column containing numbers from 1 to 9, the second column containing numbers from 10 to 19, the third column containing numbers from 20 to 29 and so on up until the last column, which contains numbers from 80 to 90. Winning patterns or combinations generally include a horizontal line, two lines, or a full house, which is similar to a coverall as all fifteen numbers on the ticket are covered.

In New Zealand bonus games (Super Housie), often three lines may be claimed—top, middle and bottom. In the UK, however, it is most common for a line game to be followed directly by a two-line game and a full house game, or just by a full house game with the same balls and cards for multiple games.

As previously described, various types of bingo games may use different types of progressive prizes. The first involves increasing a prize amount based on contributing a portion (either fixed amount or percentage) of each ticket sold to the progressive prize pool. Some progressive prize pools are increased per unit of time, such as a day, week, etc. Progressive prize pools may be grouped in different ways, including by winning pattern, days of the week, bingo session (time of day), etc. Some progressive prize games may change the contribution amount after the game starts and/or stop contributions once the prize reaches a certain value.

Another type of progressive game used in bingo and related games increases the number of called balls to achieve the winning criterion for a given prize. For example, a bingo game with 75 numbers may offer a prize of $10,000 for a coverall achieved with 47 or fewer numbers called. If there are no winners the first week, the same prize may be offered in a new game for a coverall achieved with 48 or fewer calls the next week. The number of calls may be increased each week up to a maximum limit that is less than or equal to the number of possible selections and kept at the selected maximum number of calls until the prize is won. Other winning criterion may include matching objects on the player card to form a designated pattern, such as a line, cluster, postage stamp, diagonal, four corners, or similar patterns.

In virtually all keno, lottery, bingo, and slot machines the progressive portion of the prize is split when there are multiple winners. The progressive portion is the current amount of the progressive meter less the amount of the base jackpot. The progressive portion grows by allocating a percentage of every wager to the progressive meter. Thus, when there are multiple winners, the progressive amount is generally split evenly among all winners. For example, a game starts with a base jackpot of $100,000. As players make wagers, a portion of each wager is added to the progressive meter causing it to grow to $140,000. If two people were to win the progressive jackpot during the same game, they would each be paid the base amount of $100,000 in addition to half of the progressive amount of $40,000 for a total prize award of $120,000. Additionally, in many instances the progressive prize is paid on an aggregate basis and would be split evenly among the winners for $70,000 each in this example.

The various styles of bingo and related games generally have some common features. For example, a particular game (i.e. winning criterion) ends when the first winner satisfies the winning criterion. In combined games, play may continue after a first winner, but the winning criterion and/or prize are changed for a second or subsequent winner, i.e. a single line followed by double line, or a double line followed by a coverall. Similarly, because many jurisdictions require bingo and related games to be played to conclusion (in contrast to keno or lotto type games where it is acceptable to not have a winner), if there is no winner matching the winning criterion within the required number of calls, the winning criterion and/or prize may be changed in a consolation game that is played until a winner is determined, for example. Another common feature of the various games, including keno, lotto, and progressive style games, is that multiple winners generally split or share the prize.

SUMMARY

Systems and methods for playing a game of chance, which may either be played as a standalone game of chance or as secondary game for players who pay a premium or are allowing to play on a promotional basis, having winning criterion associated with matching indicia such as objects, graphics, symbols, numbers, letters, or the like on a player card to indicia determined or selected by operator calls or an equivalent selection of game or house indicia identified by the gaming establishment, which may be generated manually by hand, ball cage, ball blower, playing cards, roulette wheel, etc., or electronically by a random number generator or the like, whether individually selected or selected as a group during play and/or pre-selected prior to play. The systems and methods include awarding a first prize for every player card that satisfies the winning criterion after each operator call less than or equal to a first number of operator calls and awarding a subsequent prize for every player card that satisfies the same winning criterion for at least one operator call greater than the first number and less than or equal to a second number of operator calls and continuing the game until at least all calls up to and including the second number of calls have been made.

In one embodiment, the winning criterion corresponds to a pattern of selected, determined, or called numbers on a player card achieved with less than a first number of operator calls. Rather than the game ending and the winning criterion changing after the first player (winner) achieves the winning pattern with fewer than the first number of calls and is awarded the first prize, play continues and every player that achieves the winning pattern in less than the first number of calls subsequent to the first winner is also awarded a prize. In one embodiment, the prize awarded to all subsequent winners in less than the first number of calls is the same as the first prize. In another embodiment, the prize awarded to subsequent winners in less than the first number of calls is less than the first prize. Various embodiments include splitting at least the first prize among all winners for a particular call. After the first number of calls, play continues up to a second number of calls, each of which may be generated manually by hand, ball cage, ball blower, playing cards, roulette wheel, etc., pre-called, or electronically called or sequenced by a random number generator or the like, with each call and/or predetermined specified calls (such as even calls, odd calls, every n calls, any one or more specified calls between the first number and second number, etc.) having an associated prize for satisfying the winning criterion. If no players are winners after the second number of calls, play continues until at least one player satisfies the winning criterion for an associated prize in this embodiment. Other embodiments include alternative strategies for determining at least one winner and concluding the game.

In one embodiment, a system for playing a game of chance includes a plurality of player cards each having a first plurality of indicia selected from a pool of a second plurality of indicia, a device for determining or selecting called, game, or house indicia from the pool of indicia, and a display associated with the device for determining or selecting called indicia and displaying the indicia, the display viewable by game players, wherein the system includes an associated pay table that awards a first prize for every player card that satisfies a first winning criterion up to and including a first number of selected house indicia and subsequent prizes for every player card that satisfies the first winning criterion after the first number of house indicia up to and including a second number of selected indicia. Various prizes may be awarded on a split or no-split basis depending on the particular implementation. In one embodiment, the display comprises a video display. Embodiments include systems or devices having an associated pay table that includes a consolation prize awarded for a player card that satisfies the first winning criterion after the second number of house indicia is determined, selected, or called. Alternatively a second winning criterion may be used for the consolation prize, or a pay table having prizes associated with each possible number of matches for all player cards after the second number of calls may be used to conclude the game after a fixed number of calls.

Systems and methods for gaming according to embodiments of the present disclosure have a number of associated advantages. For example, the multi-win style of gaming according to the present disclosure provides players more excitement and encourages players to cheer for one another rather than cursing when the first winner takes the prize and ends the game by continuing the game until at least all calls, and associated winning chances, up to and including the second number of calls have been made. Various embodiments according to the present disclosure provide more winners, which may be paid by a third-party, with associated fewer consolation prizes paid by the gaming establishment operator. Similarly, embodiments according to the present disclosure offer multiple chances to win no-split prizes, which facilitates reduction in consolation prize expenses. In addition, various embodiments allow operators to generate more profit and eliminate prize exposure in favor of a fixed cost per ticket such that profits increase with increased ticket sales.

Gaming strategies according to the present disclosure may be applied to virtually any existing or future variations of bingo and similar games of chance. Various embodiments may be used with any winning pattern, combination, or number selections and the like. Cards or tickets may comprise paper, card stock, fixed, portable, or handheld electronic displays, and the like. Embodiments according to the present disclosure may be applied to fixed odds payouts, pari-mutuel, progressive, or any combination thereof. Similarly, embodiments may also be played with any approved method of determining, selecting, or calling house or game indicia such as numbers, words, or other elements to be matched including but not limited to pre-called games, random number generators, ball blowers, card draws, roulette style draws, and the like.

Various embodiments of gaming with a Multi-Win feature according to the present disclosure may be played with at least two players each playing one or more card faces. Multi-player implementations may be required in some jurisdictions. For example, Class II gaming generally requires the game to be played with at least two players. In addition, various embodiments of the present disclosure may include one or more players playing one or more cards against the house, which may play one or more selected cards. The Multi-Win feature of the present disclosure may also be used in various computer or machine based implementations.

The above advantages and other advantages and features will be readily apparent from the following detailed description of the preferred embodiments when taken in connection with the accompanying drawings.

BRIEF DESCRIPTION OF THE DRAWINGS

Embodiments of the present disclosure described herein are recited with particularity in the appended claims. However, other features will become more apparent, and the embodiments may be best understood by referring to the following detailed description in conjunction with the accompanying drawings, in which:

DETAILED DESCRIPTION

Figure 1:
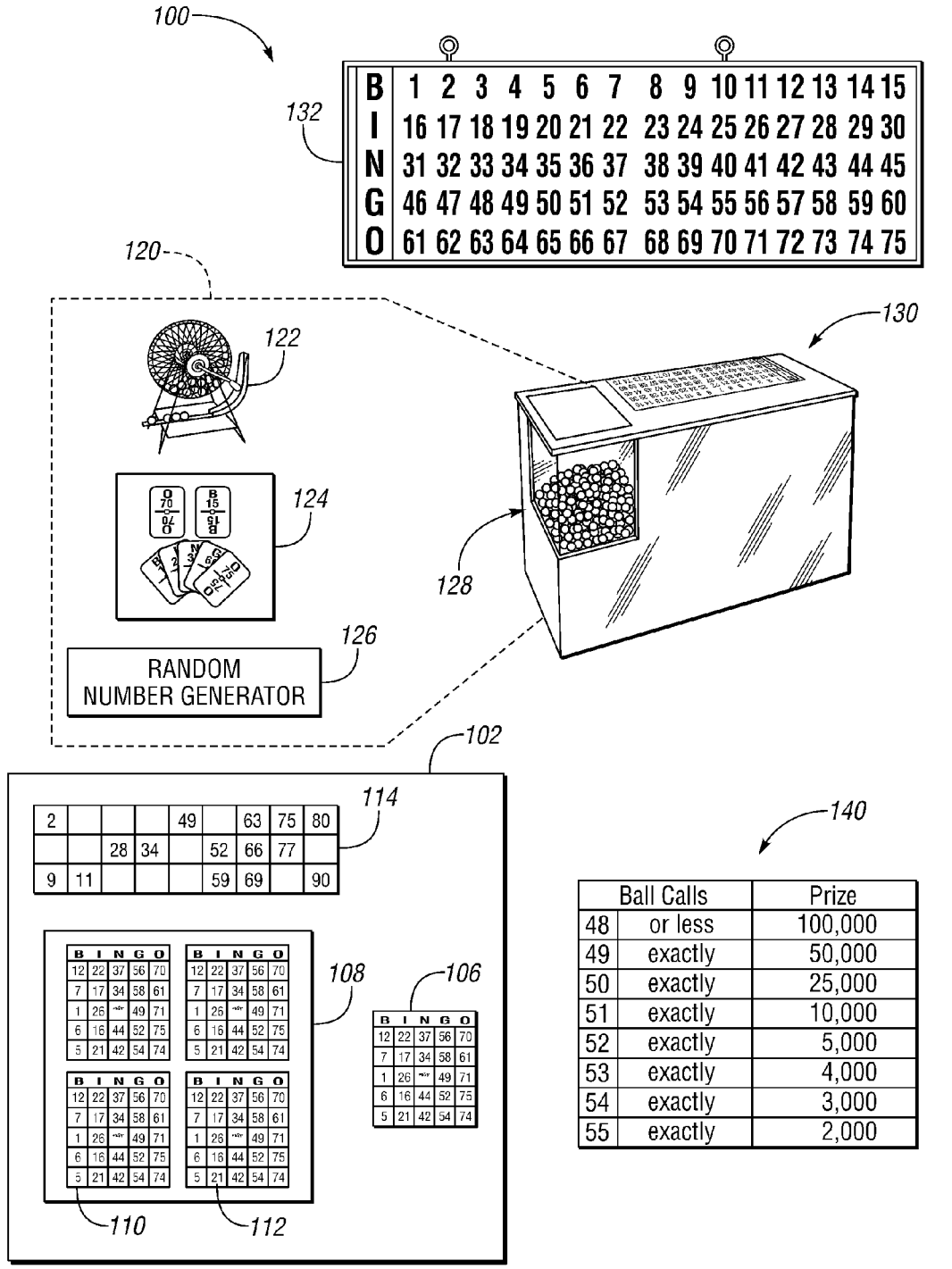
FIG. 1 is a block diagram illustrating operation of a system or method for playing a game of chance having a Multi-Win feature according to various embodiments of the present disclosure.

As those of ordinary skill in the art will understand, various features of the embodiments illustrated and described with reference to any one of the Figures may be combined with features illustrated in one or more other Figures to produce embodiments that may not be explicitly illustrated or described in detail. The combinations of features illustrated provide representative embodiments for typical gaming applications for bingo and related games. However, various combinations and modifications of the features consistent with the teachings of the present disclosure may be desired for particular applications or implementations. The representative embodiments used in the illustrations relate generally to a game of chance, such as bingo or a related game, with multiple prizes and/or winners. Those of ordinary skill in the art may recognize similar games or other applications or implementations not specifically described, but that are within the scope of the claims.

The descriptions of various styles of bingo and related gaming are purely illustrative. The systems and methods for gaming according to various embodiments of the present disclosure are generally independent of the size of the pool of indicia and are not limited to the 75 or 90 indicia, elements, balls, or numbers used in various representative embodiments. In addition, those of ordinary skill in the art will recognize that any reference to balls or ball calls apply equally to games where other indicia such as letters, words, names, symbols, constellations, figures, patterns, and the like may be used in place of, or in combination with numbers In general, the Multi-Win feature described with reference to various embodiments of the present disclosure is independent of the particular manner or strategy for selecting, determining, sequencing, calling, etc. of the house or game indicia. As such, the winning combination, matched selection, number of matches, or pattern of matches for any game may generally be obtained by any predetermined or random selection of indicia using manual, electrical, mechanical, electronic, or computer controlled or assisted devices to match less than or equal to the total number of possible selections. Likewise, operator calls, house or game indicia may be determined, selected, or sequenced individually one at a time, and/or in groups or sets and subsequently displayed or otherwise provided to game players. Whether selected individually or as a group or set, house or game indicia may be displayed or presented individually and/or as a group. For example, a group of game or house indicia may be pre-selected prior to the beginning of a game and displayed or presented as a group to the players. Subsequent selection and presentation may occur for individual calls in substantially real time during game play. As another example, all of the available pool of indicia may be pre-selected or sequenced prior to game play and then called or presented individually to the game players to determine prize awards as described herein.

Those of ordinary skill in the art will recognize that the multi-win strategies illustrated in various embodiments of the present disclosure may be applied to virtually any existing or future variation of bingo and related games. The multi-win strategies may be used with any winning pattern, combination, number selections, and the like. Similarly, various embodiments of the present disclosure may be played on paper, card stock, or electronically via a video screen on a kiosk or handheld device, for example. Multi-win strategies according to embodiments of the present disclosure may be applied to games based on fixed odds payouts, pari-mutuel, progressive jackpots, or any combination thereof. Similarly, although various embodiments may refer to a ball call, an operator call or more generally selection or determination of house or game indicia, the multi-win strategies illustrated may be used in games that incorporate various methods for selecting or determining house or game indicia, which may include a number, letter, word, graphic, picture, etc., including but not limited to pre-called games, random number generators, ball blowers, card draws, roulette style draws, and the like. Depending on the particular application and implementation, an operator call or selection or determination of house or game indicia may be performed individually and/or in sets or groups of indicia during game play and/or prior to game play. For example, all FIG. 1 is a block diagram illustrating operation of a system or method for playing a game of chance having a Multi-Win feature according to various embodiments of the present disclosure. System 100 includes a plurality of player cards 102. The actual type, arrangement, and content of player cards 102 may vary by the game being played. Cards 102 include two different types of cards that have various common features, such as indicia or objects (numbers in this example) arranged in a grid, table, or array having a plurality of rows and columns. Of course, other arrangements of numbers or other objects are possible that are not in a two-dimensional array. Cards 102 generally include a first plurality of objects, 24 numbers in this example, selected from a pool of a second plurality of objects, such as 75 numbers, for example. The objects may be prearranged in a particular order or pattern, typically randomly. In some games, game players may optionally pick some of the numbers and/or arrange the numbers on the card as described in greater detail herein. In the embodiment illustrated, player card 106 includes a single card face having 24 numbers and a free space arranged in rows and columns with each column labeled with a letter, B, I, N, G, O, in this example. Card 108 includes multiple card faces 110, 112 that may be played for a single game, or may be used for multiple games or combination games depending on the particular implementation.

As also illustrated in FIG. 1, various embodiments having a Multi-Win feature according to the present disclosure may be played with a player card or ticket 114 such as commonly used in Europe, for example. Ticket 114 includes three rows and nine columns with five numbers or objects and four spaces in each row and at least one number or object in each column. Although multi-face cards 108 and single cards 106 may be used in a single game, most games would not include different types of cards, such as cards 114 and 106, for example. However, the Multi-Win feature of various games according to the present disclosure does not preclude the use of more than one type of card in any particular game.

System 100 includes at least one device as generally represented by reference numeral 120 for selecting called objects from a pool of objects. For example, device 120 may be implemented by one or more of a ball cage 122, a deck of cards 124, an electronic or computer controlled random number generator 126, or a ball blower 128, although typically only one device is used in any particular game. The present disclosure is independent of the particular type of device 120 or method used to select, sequence, or otherwise determine called numbers or objects as previously described. A master table, chart, or board 130 may be used to keep track of called numbers in combination with a display 132 viewable by game players. In the embodiment of FIG. 1, display 132 is implemented by a bingo flashboard that displays each called number. Display 132 may have the numbers or objects arranged in rows and columns as shown, or in any other convenient format. In one embodiment, the winning criterion for a prize is determined based on at least in part on a pattern of numbers as arranged on flashboard 132. The winning criterion or criteria may also include a predetermined number of matching numbers and/or a pattern of matching numbers on a player card 102 as described in greater detail herein.

System 100 includes an associated prize schedule or pay table 140 that governs awarding of prizes and prize amounts for satisfying various winning criterion. As illustrated in FIG. 1, pay table 140 awards a first prize of $100,000 for every player card 102 that satisfies a first winning criterion, which is a coverall in this example, up to and including a first number of calls. As such, any card 102 that matches all 24 numbers in 48 calls or less is awarded the first prize of $100,000. In this embodiment, pay table 140 also includes prize amounts for awarding one or more subsequent prizes for every player card 102 that satisfies the first winning criterion (coverall or matching 24 numbers) after the first number of calls up to and including a second number of calls, which is 55 in this example. Other embodiments may include only a single intermediate call number with an associated prize, or a group or set of predetermined call numbers between 48 and 55 calls that have associated prize amounts. For example, a prize may only be awarded for satisfying the winning criterion at 48 calls or less, 50 calls, and 55 calls. The prize amounts may be paid on a no-split basis, divided among multiple simultaneous winners, or some combination thereof, depending on the particular implementation. System 100 may also include a consolation prize (not specifically illustrated in this embodiment) awarded for a player card 102 that satisfies the first winning criterion after the second number of calls, i.e. play may continue until at least one player matches all 24 numbers or objects on a card. Alternatively, a pay table 140 having prizes associated with each possible number of matches for all player cards may be used as described in greater detail below The game only ends once all calls up to and including the second number of calls have been made and cannot end simply because a player or players have achieved the prescribed winning criterion pattern or number beforehand.

System 100 may be used in various types of games with associated pay tables 140 as described herein. In one embodiment, with a modified pay table from that illustrated, a game offers a prize of $10,000 to players that achieve a coverall in 50 or fewer ball calls. In contrast to a traditional game where the game ends when a player wins on the 47th call, for example, the Multi-Win bingo game according to the present disclosure would not be over and the other players would still have a chance to win the $10,000 top prize through the $50^{th}$ call. In a Multi-Win game of bingo or similar game according to the present disclosure, after the player is paid for winning on the $47^{th}$ call, the $48^{th}$ number is drawn and any winners would be awarded the top prize of $10,000. Then the $49^{th}$ and $50^{th}$ numbers are drawn and called and any winners are paid $10,000. Additionally, in this embodiment, all winners are paid the full amount even if there are multiple winners at a given ball call. For example, if three people achieve the winning pattern when the 49th number is drawn, they are each paid the full prize amount of $10,000.

Various embodiments according to the present disclosure include no-split progressive prizes or jackpots that may be in addition to the prizes awarded according to the associated prize schedule or pay table. For any game, the odds of multiple winners may be computed as described herein. Once these probabilities have been determined, the percentage or amount of each wager contributed to the progressive meter is determined. Having factored in the additional cost of multiple winners, the operator may offer to pay progressive jackpots in full to all winners on a no-split basis. Depending on the particular implementation, a third-party or entity separate from the operator may assume financial responsibility for paying prizes awarded according to the pay table or prize schedule, with the operator responsible for consolation prizes, if any. Of course, the third-party or other entity obtains a fee associated with the game that may be a commission, percentage or similar fee, for example.

Alternatively, or in combination, tiered prizes or awards may be provided. Instead of offering only a single prize amount up to prescribed number of ball calls, several prizes may be offered together and tiered according to the ball call after the prescribed number of ball calls for the top prize. The following table represents a prize schedule for the representative embodiment illustrated in FIG. 1 with tiered prizes or awards according to the present disclosure:

| Calls | | Prize |
|---|---|---|
| 48 | or less | 100,000 |
| 49 | exactly | 50,000 |
| 50 | exactly | 25,000 |
| 51 | exactly | 10,000 |
| 52 | exactly | 5,000 |
| 53 | exactly | 4,000 |
| 54 | exactly | 3,000 |
| 55 | exactly | 2,000 |

In this embodiment, the game ends after a second number of operator calls, e.g., a fixed number of calls, such as 55 in this example, if one or more player cards satisfied the winning criterion. Including a Multi-Win feature according to embodiments of the present disclosure awards the first prize of $100,000 to every player that satisfies the winning criterion in less than or equal to 48 calls, and the game continues through the $55^{th}$ call and awards subsequent prizes for each card satisfying the same winning criterion. For example, a winner satisfying the winning criterion (coverall in this example) after 46 calls is awarded the first prize and play continues with the same winning criterion. A winner after 47 calls or 48 calls is also awarded the first prize of $100,000. Play continues with the $49^{th}$ call and any player cards meeting the winning criterion (coverall) are paid $50,000. Play continues through the end of the prize board or pay table, which includes 55 calls in this example. The game does not end prior to all calls up to and including the second number of calls have been. However, if none of the player cards satisfies the winning criterion after 55 calls, the game may use on or more means or devices to conclude the game in different ways depending on the particular implementation. In one embodiment, play continues until the first call where at least one player card satisfies the first winning criterion. In another embodiment, the Multi-Win game is combined with a consolation game having a second winning criterion to determine a consolation or standard prize winner. For example, the first criterion may be a single line, and the second criterion a coverall. Alternatively, or in combination, rather than continuing calls for a consolation prize, which requires a varying number of calls to establish a winner, the game may use a device such as a strategy, rule, pay table, computer, machine, etc. that ends or concludes the game at any fixed number of calls with a corresponding prize schedule that accounts for all remaining possible outcomes. In this example with player cards each having 24 numbers and a total pool of 75 numbers, the game could be concluded after 55 calls by combining the above pay table with a pay table having an associated prize for matching between 0 and 23 numbers as described in greater detail herein.

In another embodiment, alternatively, or in combination, tiered prizes or awards may be provided. Instead of offering only a single prize amount up to a prescribed number of ball calls, several prizes may be offered together and tiered according to the ball call after the prescribed number of ball calls for the top prize.

Various embodiments may include pay tables that do not have a prize associated with every call between the first number of calls associated with the first prize and the second number of calls associated with the last non-consolation prize. The following pay tables represent a prize schedule for a representative embodiment as illustrated in FIG. 1 with tiered prizes or awards wherein the prescribed ball call winning numbers are comprised of one or more numbers of calls between the first number of calls for the first prize and the second number of calls for the last non-consolation prize where at least some calls do not have corresponding prizes. In the first example, the following pay table provides a first prize for matching a first winning criterion with 48 calls or less of $100,000, with subsequent even numbers of calls at 50, 52, etc. having associated tiered prize awards. Similarly, the second example provides a pay table awarding a first prize of $100,000 for cards satisfying the first winning criterion in 47 calls or less, with subsequent odd numbers of calls at 49, 51, etc. having corresponding tiered prize awards according to the present disclosure:

| Calls | | Prize |
|---|---|---|
| 48 | or less | 100,000 |
| 50 | Exactly | 35,000 |
| 52 | exactly | 5,000 |
| 54 | exactly | 3000 |
| 56 | exactly | 1,000 |
| 47 | or less | 100,000 |
| 49 | exactly | 50,000 |
| 51 | exactly | 5,000 |
| 53 | exactly | 3000 |
| 55 | exactly | 1,000 |

In this embodiment, the game ends after a second fixed number of operator calls, each of which may be generated manually by hand, ball cage, ball blower, playing cards, roulette wheel, etc., pre-called, or electronically by a random number generator or the like, such as 56 in the first example, if one or more player cards satisfied the winning criterion. Including a plurality Multi-Win feature according to various embodiments of the present disclosure awards the first prize of $100,000 to every player that satisfies the winning criterion in less than or equal to 48 calls, and the game continues through the $56^{th}$ call and awards subsequent prizes for each card satisfying the same winning criterion with a corresponding prize award from the pay table. For example, a winner satisfying the winning criterion (coverall in this example) after 47 calls is awarded the first prize and play continues with the same winning criterion. A winner after 48 calls is also awarded the first prize of $100,000. Play continues through the end of the prize board or pay table, which includes 56 calls in the first example. However, if none of the player cards satisfies the winning criterion after 56 calls, the game may be concluded in different ways depending on the particular implementation. In one embodiment, play continues until the first call where at least one player card satisfies the winning criterion. In another embodiment, a second winning criterion is used to determine a consolation or standard prize winner. For example, the first criterion may be a single line, and the second criterion a coverall. Alternatively, or in combination, rather than continuing calls for a consolation prize, which requires a varying number of calls to establish a winner, the game may be concluded at any fixed number of calls with a corresponding prize schedule that accounts for all remaining possible outcomes. In the first example with player cards each having 24 numbers and a total pool of 75 numbers, the game could be concluded after 56 calls by combining the above pay table with a pay table having an associated prize for matching between 0 and 23 numbers as described in greater detail herein. The odd embodiment operates in a similar manner.

As previously described, one of the advantages of the multi-win strategy of the present disclosure is the ability to apply it to a number of variations to maintain player interest and excitement. In a pure no-split variation, all players who meet the winning criterion are each paid the associated prize without splitting or sharing the prize if multiple winners meet the criterion after any particular call. For example, in a game where the winning criterion requires a particular pattern, such as a coverall, in 48 calls or less, every player satisfying the criterion within 48 calls would each be paid or awarded the same prize of $100,000, for example, without any splits. As such, if there is one winner at 46 calls, the winner is paid $100,000. If the $47^{th}$ call results in two additional winners, each winner is paid $100,000, and so on through the $48^{th}$ number called. The game continues and all winners are paid or awarded associated prizes through the 55th ball call. If there are no winners, the game continues for the consolation prize, or is concluded with a pay table accounting for all remaining possible outcomes. The game may only end once all calls up to and including the second number of calls have been made and a player or players have achieved the prescribed winning criterion pattern or number.

Another advantage of the multi-win system and method is to allow for play either as a primary game or secondary simultaneous game, formatted relative to the primary game, available to players who pay an additional fee and/or awarded to players on a promotional basis wherein only those select players are allowed to participate in possible longer game play while for the other players, the game has ended. Thus generating additional revenue for the operator or maintaining a level of loyalty of customers. Many gaming operators have player's clubs which distribute player cards which award points dependent upon the amount wagered and/or amount of time played. Commonly, an operator may create differing levels of player cards such as a silver card, a gold card, and a platinum card. Accordingly, by example, an operator may require a player without a player card or a player with only a silver card status to pay a premium to play a secondary simultaneous game while awarding free play to players with a gold or platinum card.

In another embodiment, the grand prize is only awarded to the first winner or winners. In this variation, the grand prize is split or shared in the event of multiple winners associated with a particular call. Once the grand prize has been awarded, the game continues for the next prize level, such as $50,000 in this representative embodiment. For example, if a player card satisfies the winning criterion at 46 calls, that player card is awarded a prize of $100,000 (multiple winners would split the prize equally). The game would continue and any players that achieve winning combinations at operator calls 47, 48, or 49 would each be paid the next prize level of $50,000. This embodiment limits the prize exposure for the operator. The operator call and associated prizes continue through the predetermined number of calls, i.e. through the $55^{th}$ ball call in this example. If there are no winners after the $55^{th}$ call, the game continues for the consolation prize. In another variation of this embodiment, the grand prize is paid in full on a no split basis to the first winner or winners. Then players play for the next or second prize level until the first number of calls is completed. Subsequent calls may each have an associated prize award until a predetermined number of calls is completed. If there are no winners after the predetermined number of calls, play continues for a consolation prize until a winner is determined, or for a fixed number of calls with a pay table accounting for all remaining possible outcomes.

As previously described, any of the embodiments may be combined to create multiple combinations and may be played as the primary game of chance or as a secondary game of chance for players who pay an additional fee or are awarded to players on a promotional basis with the game continuing until at least all calls, and associated winning chances, up to and including the second number of calls have been made. For example, the following table provides representative combinations of a grand prize and secondary prize. Any of the grand prize strategies in the grand prize column may be combined with any of the secondary prize strategies in the secondary prize column to determine the awards for a particular game as follows:

| Grand Prize | Secondary Prize |
|---|---|
| Grand prize is paid in full to all winners at or below a given ball call | Secondary prize is paid in full to all winners at or below a given ball call |
| Grand prize is paid on a no split basis to the first winner or winners | Secondary prize is paid on a no split basis to the first winner or winners |
| Grand prize is paid on an aggregate basis and can only be paid once during any given game, multiple winners would split the prize | Secondary prize is paid on an aggregate basis and can only be paid once during any given game, multiple winners would split the prize |

These variations may be successively applied to other prize levels, individually or collectively, creating numerous possible combinations. In addition, any of these variations can be structured to include one or several progressive prize elements.

Although bingo games and related games of chance generally have winning criterion based on forming a pattern on a player card, some games offer a prize for correctly matching a predetermined number of the called numbers on a playing card after a particular number of calls. For example, a grand prize may be awarded for matching 8 numbers on a card after 20 calls. The multi-win version of this game according to one embodiment of the present disclosure offers different prize levels on a no-split basis depending on the number of matches after the predetermined number of calls. The following is a pay table or prize schedule for a representative embodiment:

| Match | Prize |
|---|---|
| 8 | 25,000 |
| 7 | 500 |
| 6 | 50 |
| 5 | 5 |

The above prize schedule is based on a representative embodiment with a pool of 75 numbers or objects of which 20 are selected. Of course, one of ordinary skill in the art will recognize that a series of pay tables may be constructed for different numbers of calls and associated prizes offered individually or collectively. For example, in one embodiment, prize structures are established for 8 through 75 calls. Once a player correctly matches all 8 selected numbers, the rest of the players win the corresponding prize for that call. The same type of game structure may be established for any set of initial number selections, whether they are selected by the player, randomly generated, or any combination thereof less than or equal to the number of selections that are possible.

The Multi-Win Pick embodiment may also be designed to have different triggering events other than having X matches after a predetermined number of calls. For example, the triggering event may be associated with: a pattern on the master flash board, a pattern on any electronic card, a pattern on any paper card, a pattern on any card in play, a pattern on a randomly selected card, etc. These triggering events or patterns may or may not have anything to do with the underlying process of matching X selections to a draw of Y numbers.

As previously described, the consolation prize element of various types of bingo and related games may be a significant operating expense. Although bingo regulations vary considerably by jurisdiction, they generally include a requirement that the game must be played to conclusion, i.e. there must be at least one winner. Multi-Win strategies according to various embodiments of the present disclosure may be used to reduce or eliminate consolation prizes by offering tiered prizes that include payouts for all possible outcomes.

One embodiment of a pay table according to the present disclosure that may be used to provide a payout for all possible outcomes for a Pick 8 game is provided below:

| Match | Prize |
|---|---|
| 8 | 25,000.00 |
| 7 | 25.00 |
| 6 | 5.00 |
| 5 | 3.00 |
| 4 | 2.00 |
| 3 | 1.00 |
| 2 | 0.25 |
| 1 | 0.10 |
| 0 | 0.05 |

This concept may be applied to any bingo or related game that utilizes the underlying process of matching X selections (shown in the Match column of the prize table) to a draw of Y numbers (20 in this example). Similarly, a pay table or prize schedule having payouts for all possible outcomes may be applied to various other types of bingo and related games as previously described.

A prize schedule or pay table for a bingo coverall game having a maximum number of calls according to one embodiment of the present disclosure is shown below. The prize schedule accounts for all possible outcomes after the scheduled maximum number of calls have been completed. In this example using cards having 24 numbers, words, or other objects, the prize schedule includes a non-zero prize award for all possible number of matches from zero through 24. Depending on the number of calls, the prize schedule may account for only the remaining possible outcomes depending on how the numbers are assigned to the cards.

| Match | Prize |
|---|---|
| 24 | 100,000.00 |
| 23 | 5,000.00 |
| 22 | 4,000.00 |
| 21 | 3,000.00 |
| 20 | 2,000.00 |
| 19 | 1,000.00 |
| 18 | 500.00 |
| 17 | 50.00 |
| 16 | 20.00 |
| 15 | 10.00 |
| 14 | 5.00 |
| 13 | 0.50 |
| 12 | 0.25 |
| 11 | 0.05 |
| 10 | 0.05 |
| 9 | 0.05 |
| 8 | 0.05 |
| 7 | 0.05 |
| 6 | 0.05 |
| 5 | 0.05 |
| 4 | 0.25 |
| 3 | 0.50 |
| 2 | 3,000.00 |
| 1 | 5,000.00 |
| 0 | 10,000.00 |

If none of the cards satisfy the winning criterion (a coverall, for example) within the maximum scheduled number of calls (47, for example), players are paid or awarded a prize based on the total number of matches to the called indicia on each card or ticket for that game. For pattern games, such as a Letter X, in which the winning pattern corresponds to matching indicia arranged along both diagonals of the grid or array, the prize may be determined based on only the matching indicia making up the winning pattern, or alternatively based on all the matching indicia on the winning card or face. This strategy may be applied to any type of bingo or related game.

In another embodiment, the pay table or prize schedule includes prizes for some, but not all possible outcomes. This would reduce, but not eliminate the necessity of a consolation prize award to meet the requirement that the game is played to conclusion. Games structured in this fashion also have the added operator incentive of a fixed or maximum number of calls. Embodiments having a fixed or maximum draw or number of calls provide operators greater certainty in scheduling games as the time required to complete each game does not vary based on the number of calls required to determine a winner.

As those of ordinary skill in the art will appreciate, any game structured with payouts for all possible combinations effectively allows the operator to offer a pari-mutuel game without having any progressive meters or allocations.

Various embodiments according to the present disclosure provide multiple potential payouts by awarding prizes to players that have substantially satisfied the winning criterion, i.e. almost achieved a winning pattern or combination. The following is a pay table that may be used in a representative embodiment of a European style game with 38 calls or less:

| Match | Prize |
|---|---|
| 15 | 100,000.00 |
| 14 | 2,000.00 |
| 13 | 1,000.00 |
| 12 | 100.00 |
| 11 | 10.00 |

Other embodiments according to the present disclosure provide a matrix of possible prizes. The following table is a representative prize matrix for a bingo coverall with columns corresponding to calls 47-50 and rows corresponding to matches 24-20:

| | Call | | | |
|---|---|---|---|---|
| Match | 47 | 48 | 49 | 50 |
| 24 | 50,000 | 10,000 | 5,000 | 3,000 |
| 23 | 5,000 | 2,500 | 2,000 | 2,500 |
| 22 | 3,000 | 2,000 | 1,000 | 1,500 |
| 21 | 2,000 | 1,000 | 750 | 1,000 |
| 20 | 1,000 | 500 | 500 | 500 |

These prizes may be offered collectively or individually, by row, column, or entire matrix, etc. Additionally, if the entire matrix is not offered, the triggering event that determines the prize levels can be a top prize winner, a winner at another level, achieving a particular pattern on the card, etc. depending on the particular implementation. Similarly, the matrix may include one or more zero entries where no prize is awarded for a particular call/match combination.

Figure 2:
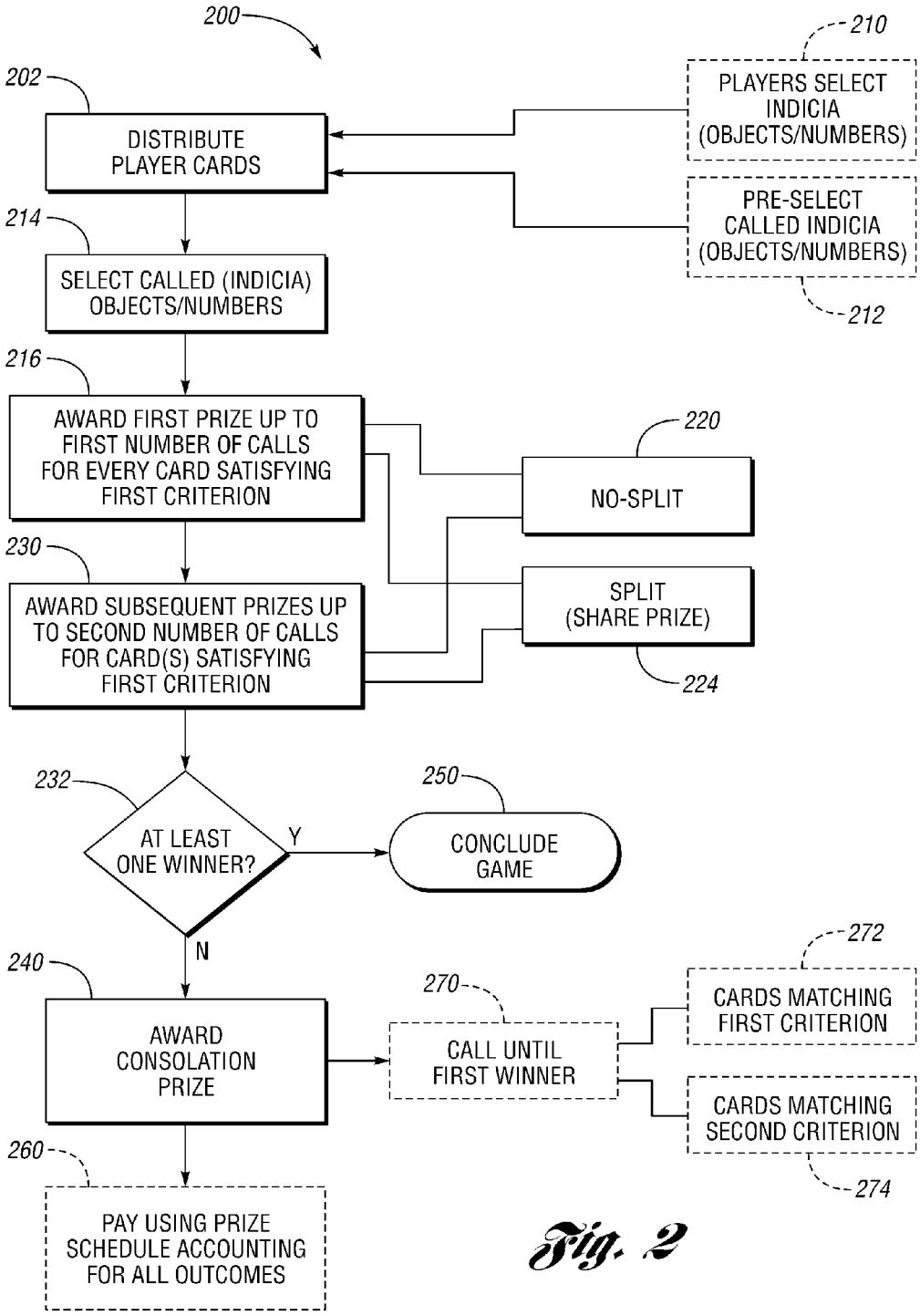
FIG. 2 is an alternative representation illustrating a system or method for playing a game of chance such as bingo or a related game having multiple prizes and/or winners according to embodiments of the present disclosure.

FIG. 2 is an alternative representation illustrating a system or method for playing a game of chance such as bingo or a related game having multiple prizes and/or winners according to embodiments of the present disclosure. System or method 200 may include distributing a plurality of player cards each having a first plurality of indicia such as numbers selected from a pool having a second plurality of indicia as generally represented by block 202. The first plurality of indicia (numbers, symbols, graphics, words, or other objects, etc.) may be prearranged on each card. In one embodiment players may select objects or numbers for each purchased player card and/or arrange selected numbers within a corresponding array or grid subject to various limitations as generally represented by block 210. Similarly, some games may include pre-selecting a predetermined number of called game or house indicia (objects, numbers, etc.) as represented by block 212. The game continues with the operator (implemented by computer in some cases) repeatedly reporting or calling house indicia that may be sequenced, selected, or otherwise randomly generated or determined individually and/or in groups before and/or during game play as generally represented by block 214. After each called number up to and including a first number of calls, a prize is awarded for every card that includes objects satisfying a first winning criterion as represented by block 216. The first prize may be awarded on a no-split basis as represented by block 220 or on a shared or aggregate basis as represented by block 224. The first winning criterion may include matching a predetermined number of objects on the player card with objects determined by the operator calls, for example, or may include matching objects on the player card to form a designated pattern, such as a line, cluster, postage stamp, diagonal, four corners, or similar pattern. Alternatively, the first winning criterion may be the absence of any of a number of predetermined patterns or not matching any numbers, for example.

With continuing reference to FIG. 2, play continues after the first number of operator calls with subsequent or secondary prizes awarded for each card satisfying the first winning criterion up to and including a second number of calls as represented by block 230. Similar to the top prize, one or more of the subsequent or secondary prizes may be awarded on a no-split basis as represented by block 220, or on a shared or aggregate basis as represented by block 224. If at least one card satisfied the first winning criterion as represented by block 232, the game ends after the second number of calls as represented by block 250. If no winner is determined after the second number of calls, one or more consolation or standard prizes are awarded as represented by block 240. Depending on the particular implementation, a consolation prize may be awarded based on a prize schedule that includes a prize amount associated with each possible remaining outcome as represented by block 260 such that the game concludes in a fixed number of calls. Alternatively, or in combination, the game may continue until a consolation winner is determined, or for a third number of calls as represented by block 270. If a fixed third number of calls is specified and no winner is determined, then the consolation prizes are awarded using a pay table as described with reference to block 260. Otherwise, calls continue until at least one player card is determined to be a winner by satisfying the first winning criterion as represented by block 272. Alternatively, one or more consolation prizes may be awarded based on satisfying a second winning criterion as represented by block 274.

As previously described, various embodiments may be implemented as multi-player games, particularly where required by gaming regulations to satisfy a particular type or class of gaming. Alternatively, or in combination, various embodiments may be implemented as games with players playing one or more cards against the house, which plays one or more selected cards. Depending on the particular implementation, players may play against one another as well as one or more house cards, players may play only against the house card, the house card may be used to determine when the game ends, i.e. when the house card(s) satisfy the winning criterion, and/or the house card may be used to determine a bonus prize, for example. Similarly, games may be played with interim or intermediate prize awards for matching a corresponding interim winning criterion different from the first winning criterion. The number or occurrence of interim prizes awarded would not be considered when determining whether to conclude the game, i.e. the game would end only after at least one player satisfied the first winning criterion. Otherwise, play would continue for the consolation prize, or prizes would be awarded for all remaining possible outcomes as previously described.

Those of ordinary skill in the art will also recognize that the various embodiments of a Multi-win strategy according to the present disclosure may be used as a bonus or premium prize in combination with a conventional bingo or related game of chance. For example, only designated cards or faces may be playing according to the multi-win pay table. Designated cards may be purchased for a fixed or tiered premium relative to standard cards, or may be awarded as part of a frequent player club or other loyalty program, for example.

Most operators and players understand the benefits to offering multiple winners and/or prizes according to various embodiments of the present disclosure. A cursory examination of various embodiments of a multi-win game according to the present disclosure may suggest that the prize awards are cost prohibitive. However, the following more careful analysis demonstrates that pay tables constructed according to the present disclosure can be used effectively to provide operators with an attractive profit.

One common way in which the game of bingo is played is to offer a prize for players that achieve a designated pattern or combination in a given number of ball calls or less. As an example, a game might offer a prize of $10,000 to a player that achieves a coverall or blackout (covers all 24 numbers on a bingo card), in 50 ball calls or less. One way to compute the theoretical or expected cost of offering this prize is to compute the probabilities of a coverall occurring between 24 (the minimum number of calls required for a 25 number card with one free space) and 50 calls. This is based on an analysis of the possible winning combinations at each ball call relative to the total number of possible combinations. The number of combinations of choosing K objects from a pool of N objects can be computed as follows:

$$C\left(\frac{N}{K}\right) = \frac{N!}{K!(N-K)!}$$

Where N represents the number of objects in the pool from which to choose and K represents the number of objects chosen.

Once the number of combinations has been determined, the probability of a particular outcome, such as a winner or no winner, may be established by the ratio of that outcome to all possible outcomes. If the cumulative probability of matching 24 numbers on a bingo card after n calls is represented by P(n), then the probability of a coverall in a game with a pool of 75 possible elements or numbers can be computed according to:

$$P_{(24)} = \frac{C\left(\frac{24}{24}\right)\times\left(\frac{51}{0}\right)}{\left(\frac{75}{24}\right)}$$

$$P_{(24)} = \frac{\left(\frac{24!}{24!\times(24-24)!}\right)\left(\frac{(51)!}{51!\times(51-51)!}\right)}{\left(\frac{75!}{24!\times(75-51)!}\right)}$$

Of course, the number of combinations of 24 items selected from a pool of 24 items is 1. However, it is included in the formula above to illustrate a specific example for the generalized formula or equation. Because it is impossible to match 24 numbers in less than 24 calls, the theoretical cost or expected value (T) of offering this prize in 24 calls or less (n=24) is simply: T=P(24) times the prize value. However, in traditional prior art bingo games, the first winner generally ends the game. As such, if someone wins at 24 calls, the game is over. Thus the theoretical or expected cost of offering the same prize for n>24 is as follows:

$$T_{(n>24)}=(P_{(n)}-P_{(n-1)})\times\text{Prize}\times(1-P_{(n-1)})$$

Where $P_{(n)}-P_{(n-1)}$ is the exact probability of a coverall in n balls drawn, and $1-P_{(n-1)}$ is the probability that there was not a winner during any of the prior ball calls.

Because $P_{(n)}$ represents the cumulative probability, $P_{(n)}-P_{(n-1)}$ is computed to provide the exact probability of achieving the pattern in n calls for n>24. Additionally, because in traditional bingo the game would be over if someone were to win after 24 ball calls (n=24), for n>24 the probability that there was not a winner at the prior ball call must also be included, as represented by the $(1-P_{(n-1)})$ term.

The following table provides a comparison of probabilities for a traditional prior art bingo game and a Multi-Win strategy according to various embodiments of the present disclosure:

| Calls | Cumulative Probability $P_{(n)}$ | Exact Probability $P_{(n)} - P_{(n-1)}$ | Traditional Bingo $(P_{(n)} - P_{(n-1)}) \times (1 - P_{(n-1)}) \times$ Prize | Multi-Win Bingo $(P_{(n)} - P_{(n-1)}) \times$ Prize |
|---|---|---|---|---|
| 24 or less | 3.879E−20 | 3.879E−20 | 3.879E−16 | 3.879E−16 |
| 25 exactly | 9.698E−19 | 9.310E−19 | 9.310E−15 | 9.310E−15 |
| 26 exactly | 1.261E−17 | 1.164E−17 | 1.164E−13 | 1.164E−13 |
| 27 exactly | 1.135E−16 | 1.009E−16 | 1.009E−12 | 1.009E−12 |
| 28 exactly | 7.943E−16 | 6.808E−16 | 6.808E−12 | 6.808E−12 |
| 29 exactly | 4.607E−15 | 3.812E−15 | 3.812E−11 | 3.812E−11 |
| 30 exactly | 2.303E−14 | 1.843E−14 | 1.843E−10 | 1.843E−10 |
| 31 exactly | 1.020E−13 | 7.897E−14 | 7.897E−10 | 7.897E−10 |
| 32 exactly | 4.080E−13 | 3.060E−13 | 3.060E−09 | 3.060E−09 |
| 33 exactly | 1.496E−12 | 1.088E−12 | 1.088E−08 | 1.088E−08 |
| 34 exactly | 5.087E−12 | 3.591E−12 | 3.591E−08 | 3.591E−08 |
| 35 exactly | 1.618E−11 | 1.110E−11 | 1.110E−07 | 1.110E−07 |
| 36 exactly | 4.855E−11 | 3.237E−11 | 3.237E−07 | 3.237E−07 |
| 37 exactly | 1.382E−10 | 8.964E−11 | 8.964E−07 | 8.964E−07 |
| 38 exactly | 3.751E−10 | 2.369E−10 | 2.369E−06 | 2.369E−06 |
| 39 exactly | 9.753E−10 | 6.002E−10 | 6.002E−06 | 6.002E−06 |
| 40 exactly | 2.438E−09 | 1.463E−09 | 1.463E−05 | 1.463E−05 |
| 41 exactly | 5.880E−09 | 3.442E−09 | 3.442E−05 | 3.442E−05 |
| 42 exactly | 1.372E−08 | 7.840E−09 | 7.840E−05 | 7.840E−05 |
| 43 exactly | 3.105E−08 | 1.733E−08 | 1.733E−04 | 1.733E−04 |
| 44 exactly | 6.831E−08 | 3.726E−08 | 3.726E−04 | 3.726E−04 |
| 45 exactly | 1.464E−07 | 7.807E−08 | 7.807E−04 | 7.807E−04 |
| 46 exactly | 3.061E−07 | 1.597E−07 | 1.597E−03 | 1.597E−03 |
| 47 exactly | 6.255E−07 | 3.194E−07 | 3.194E−03 | 3.194E−03 |
| 48 exactly | 1.251E−06 | 6.255E−07 | 6.255E−03 | 6.255E−03 |
| 49 exactly | 2.452E−06 | 1.201E−06 | 1.201E−02 | 1.201E−02 |
| 50 exactly | 4.715E−06 | 2.263E−06 | 2.263E−02 | 2.263E−02 |
| | | Total | 4.715E−02 | 4.715E−02 |

Applying the analysis above to a representative game offering a grand prize of $10,000 at 50 numbers or less in which the game is stopped (traditional prior art bingo), or a game in which the grand prize is no longer available demonstrates that the Multi-Win strategy according to the present disclosure may be used to advantage to provide acceptable operator profits.

The totals at the bottom of the table represent the sums of the respective columns and represent the expected value or theoretical cost of the prize. These results indicate that offering a prize of $10,000 in 50 calls or less yields a theoretical cost of $0.04715 per card face. Although the totals appear to be identical, there is a minor difference. The expected value or theoretical cost of the Multi-Win method according to the present disclosure is actually 0.0000000757 greater than that of the traditional prior art bingo method of play. Although this result may appear to be erroneous, and is most certainly counterintuitive, it demonstrates the feasibility of providing a multi-win gaming strategy according to embodiments of the present disclosure. The implications of these results suggest that rather than ending a game when a first player satisfies the winning criterion (or criteria) or after a predetermined number of calls with no winner, such as 47 for example, an operator can continue the game and pay all winners on a non-split basis through 50 calls, for example, at an associated additional cost of only $7.57E-08.

The computation of the theoretical cost of offering the same prize of $10,000 in 50 calls or less in the Multi Win format is a little different than that of traditional bingo. In the Multi-Win format, all players that achieve a winning pattern, or in this example a coverall, in 50 balls called or less would each be paid the $10,000. As an example, if a player achieves a coverall after 47 balls have been called, he or she would be paid $10,000. The game (same winning criterion) and the ball draws or calls would continue. If two players achieve the winning pattern on the $48^{th}$ call, each is paid $10,000. This process continues through a predetermined number of calls, such as the $50^{th}$ call in this example. The comparison of the expected costs for traditional prior art bingo relative to this embodiment of multi-win bingo according to the present disclosure can be computed as described below.

For n=24, the expected cost for each method of play is exactly identical and is equal to $P_{(24)}$ times the prize amount for each method of play. Below are the formulas for each method of play for n>24.

For traditional bingo:

$$T=(P_{(n)}-P_{(n-1)})*\text{Prize}*(1-P_{(n-1)})$$

For Multi-Win bingo:

$$T=(P_{(n)}-P_{(n-1)})*\text{Prize}$$

One of the ways for computing the cost of the $10,000 prize offered at 50 numbers or less is as follows for traditional bingo:

$$T_{(50)}=P_{(24)}\times\text{Prize}+\Sigma_{n=25}^{n=50}(P_{(n)}-P_{(n-1)})\times\text{Prize}\times(1-P_{(n-1)})$$

And for Multi-Win bingo:

$$T_{(50)}=P_{(24)}\times\text{Prize}+\Sigma_{n=25}^{n=50}(P_{(n)}-P_{(n-1)})\times\text{Prize}$$

A comparison of the above computations illustrates that the only difference between them is the $(1-P_{(n-1)})$ term. This is congruent with the operational differences between the prior art games and Multi-Win games according to the present disclosure. In particular, according to various embodiments of bingo and related games having a Multi-Win feature as disclosed herein, it does not matter if someone has won on the prior ball call. Rather, play continues with each winner receiving a prize according to the prize schedule or pay table.

The following table illustrates the approximate values of the term represented by $(1-P_{(n-1)})$ for a representative embodiment of a bingo or related game having a multi-win feature according to the present disclosure. The values in the table corresponding to calls 24 through 27 are actually slightly less than the 1.0 shown in the table, but have been rounded. For example, the actual value of the $(1-P_{(n-)})$ term for n=24 is $(1-3.879\times10^{-20})$. However, as explained in greater detail below, this does not significantly impact the overall or aggregate cost of a practical game.

| Ball Calls | $(1 - P_{(n-1)})$ |
|---|---|
| 24 or less | 1.000000000000000 |
| 25 exactly | 1.000000000000000 |
| 26 exactly | 1.000000000000000 |
| 27 exactly | 1.000000000000000 |
| 28 exactly | 0.999999999999999 |
| 29 exactly | 0.999999999999996 |
| 30 exactly | 0.999999999999982 |
| 31 exactly | 0.999999999999921 |
| 32 exactly | 0.999999999999694 |
| 33 exactly | 0.999999999998912 |
| 34 exactly | 0.999999999996409 |
| 35 exactly | 0.999999999988902 |
| 36 exactly | 0.999999999967630 |
| 37 exactly | 0.999999999910360 |
| 38 exactly | 0.999999999763096 |
| 39 exactly | 0.999999999399842 |
| 40 exactly | 0.999999998537115 |

-continued

| Ball Calls | $(1 - P_{(n-1)})$ |
|---|---|
| 41 exactly | 0.999999996557919 |
| 42 exactly | 0.999999992159704 |
| 43 exactly | 0.999999982668819 |
| 44 exactly | 0.999999962737961 |
| 45 exactly | 0.999999921927156 |
| 46 exactly | 0.999999840305546 |
| 47 exactly | 0.999999680611091 |
| 48 exactly | 0.999999374530054 |
| 49 exactly | 0.999998799097703 |
| 50 exactly | 0.999997736761056 |

As indicated in the above table, even at 50 calls, the $(1-P_{(n-1)})$ term is 0.9999977, which is only 0.0000023 less than 1. Of course, the multiplicative identity requires that the product of any number and unity is that number. This effectively explains the difference or lack thereof between the probabilities associated with the prior art style of play and the Multi-Win style according to embodiments of the present disclosure, i.e. because the only difference in the computations is associated with the $(1-P_{(n-1)})$ term, which is essentially equal to one, the difference in theoretical cost is negligible for many practical scenarios. Of course, at some point the probability of a winner would become large enough that it would have a material impact on the overall cost of the different methods of play. However, this is effectively self-governing. Once the odds are such that they materially impact the overall cost differential, the related payouts become so small, or the cost becomes so large, that they become impractical to offer in an actual game.

The no-split payouts provided by various embodiments according to the present disclosure are not inconsequential. Traditional bingo games generally split prizes among multiple winners for a given call. The pure mathematical approach to the cost of the prize according to the present disclosure makes this operating practice obsolete. As demonstrated above, the theoretical cost per ticket is the same regardless of how many tickets are issued or how many winners there are for a single game or call. According to the present disclosure, the game should be continued and all cards that satisfy a particular winning criterion should be awarded the full amount of the prize without any splits, assuming the operator has a sufficient bankroll to maintain long-term operation and absorb natural short-term statistical variation.

As such, the present disclosure provides embodiments of a game of chance, such as bingo, that provide for multiple winners and/or prizes. The multi-win style of gaming according to the present disclosure provides players more excitement and encourages players to cheer for one another rather than cursing when the first winner takes the prize and ends the game. Various embodiments according to the present disclosure provide more winners that may be paid by a third-party with fewer consolation prizes paid by the gaming establishment operator. Similarly, embodiments according to the present disclosure offer multiple chances to win no-split prizes, which facilitates reduction in consolation prize expenses. In addition, various embodiments allow operators to generate more profit and eliminate prize exposure in favor of a fixed cost per ticket such that profits increase with increased ticket sales. Multi-Win gaming strategies according to the present disclosure may be applied to virtually any existing or future variations of bingo and similar games of chance. Various embodiments may be used with any winning pattern, combination, or number selections, etc. and may be played on paper, card stock, via electronic or video display screens, and the like. Embodiments according to the present disclosure may also be applied to fixed odds payouts, pari-mutuel, progressive, or any combination thereof. Similarly, embodiments may also be played with any approved method of determining, selecting, or calling numbers, words, or other elements to matched such as pre-called games, random number generators, ball blowers, card draws, roulette style draws, and the like.

While one or more embodiments have been illustrated and described, it is not intended that these embodiments illustrate and describe all possible embodiments within the scope of the claims. The words used in the specification are words of description rather than limitation, and various changes may be made without departing from the spirit and scope of the disclosure. While various embodiments may have been described as providing advantages or being preferred over other embodiments or prior art implementations with respect to one or more desired characteristics, as one skilled in the art is aware, one or more features or characteristics may be compromised to achieve desired overall attributes, which depend on the specific application and implementation. These attributes include, but are not limited to: cost, strength, durability, life cycle cost, marketability, appearance, packaging, size, serviceability, weight, manufacturability, ease of assembly, distribution, etc. The embodiments described as less desirable than other embodiments or prior art implementations with respect to one or more characteristics are not outside the scope of the disclosure and may be desirable for particular applications or implementations.

What is claimed is:

1. A method for playing a secondary game of chance having at least one winning criterion associated with matching player indicia on a player card to house indicia determined by operator calls, the method comprising:

playing the secondary game of chance simultaneously with a primary game of chance utilizing the at least one winning criterion for the primary game of chance and the secondary game of chance, wherein the primary game of chance uses a first pay table and the secondary game of chance uses a second pay table that is different from the first pay table;

allowing only select players to participate in the secondary game of chance;

awarding a first prize for every player card that satisfies the at least one winning criterion after each operator call less than or equal to a first number of operator calls;

awarding a subsequent prize to every player that satisfies the at least one winning criterion for at least one operator call after the first number of operator calls and before a second fixed number of operator calls; and continuing the secondary game of chance until at least all calls up to and including the second number of calls have been made.

2. The method of claim 1 wherein the at least one winning criterion corresponds to matching a predetermined number of indicia on the player card with the house indicia determined by the operator calls.

3. The method of claim 2 wherein the player indicia on the player card are prearranged and wherein the at least one winning criterion corresponds to a designated pattern formed on the player card by player indicia matching the house indicia determined by the operator calls.

4. The method of claim 3 wherein a prize amount is determined based on both the number of matching player indicia on the player card and the pattern formed by the matching player indicia on the player card.

5. The method of claim 1 wherein each subsequent prize is less than or equal to the first prize.

6. The method of claim 1 wherein the indicia comprise numbers, the numbers on each player card are arranged in a grid having rows and columns, and wherein each column of the grid has a corresponding letter label.

7. The method of claim 6 wherein the grid includes a first plurality of rows and a second plurality of columns and wherein the numbers are arranged in the grid with empty spaces such that each column has at least one number.

8. The method of claim 7 wherein the grid includes three rows and nine columns with 15 numbers and 12 empty spaces arranged with 5 numbers in each row.

9. The method of claim 1 further comprising:

concluding the secondary game of chance after the second number of operator calls; and awarding prizes according to the second pay table that has a prize associated with every possible remaining outcome after the second number of operator calls.

10. The method of claim 1 further comprising: randomly selecting one of the house indicia for each operator call using one of a deck of cards, a ball blower, and a random number generator.

11. The method of claim 1 wherein the player card is displayed electronically.

12. The method of claim 1 further comprising: allowing players to select a predetermined number of indicia for each purchased player card.

13. The method of claim 1 wherein the secondary game of chance is bingo and the at least one winning criterion comprises matching a predefined number of indicia on a bingo card.

14. The method of claim 1 wherein the secondary game of chance is bingo and the at least one winning criterion comprises matching a predefined pattern of objects on a bingo card.

15. A method for playing a secondary bingo game, the method comprising:

distributing a plurality of bingo cards each having a first plurality of numbers selected from a pool having a second plurality of numbers, the first plurality of numbers arranged in rows and columns on each bingo card;

playing the secondary bingo game simultaneously with a primary game of chance utilizing a winning criterion for both the primary game of chance and the secondary bingo game, wherein the primary game of chance uses a first pay table and the secondary bingo game uses a second pay table that is different from the first pay table;

allowing only select players to participate in the secondary bingo game;

repeatedly selecting called numbers from the pool and presenting the called numbers to game players;

after each called number up to and including a first number of calls, awarding a first prize for every bingo card that includes numbers satisfying the winning criterion;

awarding a subsequent prize to every player that satisfies the winning criterion after at least one designated operator call after the first number of calls and before a second fixed number of operator calls;

continuing the secondary bingo game until at least all calls up to and including the second number of calls have been made; and awarding a consolation prize for at least one bingo card if none of the bingo cards satisfied the winning criterion after the second fixed number of calls.

16. The method of claim 15 further comprising concluding the secondary bingo game after the second number of calls if none of the bingo cards satisfied the winning criterion, wherein awarding a consolation prize includes awarding a consolation prize for every bingo card based on the second pay table having a prize amount associated with each possible remaining outcome.

17. The method of claim 16 wherein at least one of the consolation prizes is greater than zero.

18. The method of claim 15 further comprising concluding the secondary bingo game when at least one consolation prize is awarded.

19. The method of claim 15 wherein the winning criterion corresponds to a pattern formed by numbers on a bingo card that match called numbers.

20. The method of claim 15 further comprising preselecting a plurality of called numbers at the start of the secondary bingo game before awarding any prizes.

21. The method of claim 15 wherein the first plurality of numbers on the bingo card are selected by a player.

22. The method of claim 15 wherein repeatedly selecting called numbers comprises selecting called numbers from at least one of a deck of cards, random number generator, ball blower, or ball cage.

23. The method of claim 15 wherein each bingo card includes a grid having three rows and nine columns with four spaces and five numbers in each row and at least one number in each column.

24. The method of claim 15 wherein a first entity has financial responsibility for paying the first prize and subsequent prizes, and a second entity has financial responsibility for paying any consolation prize.

25. The method of claim 15 wherein the winning criterion comprises matching all the numbers on a bingo card.

26. The method of claim 15 wherein the winning criterion comprises matching a predefined pattern of numbers across multiple faces.

27. A system for playing a secondary game of chance simultaneously with a first game of chance comprising:

a plurality of player cards for select players each having a first plurality of objects selected from a pool of a second plurality of objects;

a device for selecting called objects from the pool of objects;

a display associated with the device for selecting called objects and for displaying calls, the display viewable by game players, wherein the system includes a first pay table associated with the first game of chance and a second pay table associated with the secondary game of chance, wherein the second pay table awards a first prize for every player card that satisfies a winning criterion up to and including a first number of calls and subsequent prizes for every player card that satisfies the winning criterion for at least one designated call after the first number of calls and before a second number of calls, and wherein the winning criterion used for the second pay table in the secondary game of chance is also used for the first pay table in the first game of chance; and a device that concludes the secondary game of chance on or after the second number of calls have been made.

28. The system of claim 27 wherein the device for selecting called objects comprises a random number generator.

29. The system of claim 27 wherein the display comprises a video display.

30. The system of claim 27 wherein the second pay table includes prizes associated with each possible number of matches for all player cards after the second number of calls.

31. The system of claim 27 wherein the second pay table awards the same first prize for every player card that satisfies the winning criterion on a no-split basis.

32. The system of claim 27 wherein the second pay table awards the first prize on a no-split basis.

33. The system of claim 27 wherein the secondary game of chance is bingo and the winning criterion comprises matching a predefined number of objects on a bingo card.

34. The system of claim 27 wherein the secondary game of chance is bingo and the winning criterion comprises matching a predefined pattern of objects on a bingo card.

35. The system of claim 27 wherein the second pay table awards a prize for a plurality of designated calls between the first number of calls and the second number of calls.

36. The system of claim 27 wherein the second pay table awards a prize for even numbered calls between the first number of calls and the second number of calls.

37. A method for playing a secondary game of chance having a winning criterion associated with matching player indicia on a player card to house indicia determined by operator calls, the method comprising:

playing a secondary game of chance simultaneously with a primary game of chance utilizing the winning criterion for the primary game of chance and the secondary game of chance, wherein the secondary game of chance is separate from the primary game of chance such that the primary game of chance uses a first pay table and the secondary game of chance uses a second pay table that is different from the first pay table;

allowing only select players to participate in the secondary game of chance;

awarding a first prize for every player card that satisfies the winning criterion after each operator call less than or equal to a first number of operator calls;

awarding a subsequent prize to every player that satisfies the winning criterion for at least one operator call after the first number of operator calls and before a second fixed number of operator calls; and continuing the secondary game of chance until at least all calls up to and including the second number of calls have been made.

38. The method of claim 37 wherein the winning criterion corresponds to matching a predetermined number of indicia on the player card with the house indicia determined by the operator calls.

39. The method of claim 38 wherein the player indicia on the player card are prearranged and wherein the winning criterion corresponds to a designated pattern formed on the player card by player indicia matching the house indicia determined by the operator calls.

40. The method of claim 39 wherein a prize amount is determined based on both the number of matching player indicia on the player card and the pattern formed by the matching player indicia on the player card.

41. The method of claim 37 wherein each subsequent prize is less than or equal to the first prize.

42. The method of claim 37 further comprising: if no player cards have satisfied the winning criterion after the second number of calls, continuing operator calls until at least one player card satisfies a second winning criterion.

43. The method of claim 42 wherein the at least one player card satisfying the second winning criterion subsequent to the second number of operator calls is awarded a consolation prize less than any one of the first prize and the subsequent prizes.

44. The method of claim 37 wherein the indicia comprise numbers, the numbers on each player card are arranged in a grid having rows and columns, and wherein each column of the grid has a corresponding letter label.

45. The method of claim 44 wherein the grid includes a first plurality of rows and a second plurality of columns and wherein the numbers are arranged in the grid with empty spaces such that each column has at least one number.

46. The method of claim 45 wherein the grid includes three rows and nine columns with 15 numbers and 12 empty spaces arranged with 5 numbers in each row.

47. The method of claim 37 further comprising: concluding the secondary game of chance after the second number of operator calls; and awarding prizes according to the second pay table that has a prize associated with every possible remaining outcome after the second number of operator calls.

48. The method of claim 37 further comprising: selecting one of the house indicia for each operator call; displaying a representation of each selected indicia on a master display viewable by game players; awarding at least one prize based at least on a pattern formed on the master display.

49. The method of claim 37 further comprising: randomly selecting one of the house indicia for each operator call using one of a deck of cards, a ball blower, and a random number generator.

50. The method of claim 37 wherein the player card is displayed electronically.

51. The method of claim 37 further comprising: allowing players to select a predetermined number of indicia for each purchased player card.

52. The method of claim 37 wherein the secondary game of chance is bingo and the winning criterion comprises matching a predefined number of indicia on a bingo card.

53. The method of claim 37 wherein the secondary game of chance is bingo and the winning criterion comprises matching a predefined pattern of objects on a bingo card.

54. A method for playing a secondary game of chance, the method comprising:

distributing a plurality of bingo cards each having a first plurality of numbers selected from a pool having a second plurality of numbers, the first plurality of numbers arranged in rows and columns on each bingo card;

playing a secondary game of chance simultaneously with a primary game of chance utilizing a winning criterion that is the same for the primary game of chance and the secondary game of chance, wherein the primary game of chance uses a first pay table and the secondary game of chance uses a second pay table that is different from the first pay table;

allowing only select players to participate in the secondary game of chance;

repeatedly selecting called numbers from the pool and presenting the called numbers to game players;

after each called number up to and including a first number of calls, awarding a first prize for every bingo card that includes numbers satisfying the winning criterion;

awarding a subsequent prize to every player that satisfies the winning criterion after at least one designated operator call after the first number of calls and before a second fixed number of operator calls, wherein the subsequent prize is different than the first prize;

continuing the secondary game of chance until at least all calls up to and including the second number of calls have been made; and awarding a consolation prize for at least one bingo card if none of the bingo cards satisfied the winning criterion after the second fixed number of calls.

55. The method of claim 54 further comprising concluding the secondary game of chance after the second number of calls if none of the bingo cards satisfied the winning criterion, wherein awarding a consolation prize includes awarding a consolation prize for every bingo card based on the second pay table having a prize amount associated with each possible remaining outcome.

56. The method of claim 55 wherein at least one of the consolation prizes is greater than zero.

57. The method of claim 54 further comprising concluding the secondary game of chance when at least one consolation prize is awarded.

58. The method of claim 54 wherein the winning criterion corresponds to a pattern formed by numbers on a bingo card that match called numbers.

59. The method of claim 54 further comprising preselecting a plurality of called numbers at the start of the secondary game of chance before awarding any prizes.

60. The method of claim 54 wherein the first plurality of numbers on the bingo card are selected by a player.

61. The method of claim 54 wherein repeatedly selecting called numbers comprises selecting called numbers from at least one of a deck of cards, random number generator, ball blower, or ball cage.

62. The method of claim 54 wherein each bingo card includes a grid having three rows and nine columns with four spaces and five numbers in each row and at least one number in each column.

63. The method of claim 54 wherein a first entity has financial responsibility for paying the first prize and subsequent prizes, and a second entity has financial responsibility for paying any consolation prize.

64. The method of claim 54 wherein the winning criterion comprises matching all the numbers on a bingo card.

65. The method of claim 54 wherein the winning criterion comprises matching a predefined pattern of numbers across multiple faces.

66. A system for playing a secondary game of chance simultaneously with a first game of chance comprising:

a plurality of player cards for select players each having a first plurality of objects selected from a pool of a second plurality of objects;

a device for selecting called objects from the pool of objects;

a display associated with the device for selecting called objects and for displaying calls, the display viewable by game players, wherein the system includes a first pay table associated with the first game of chance and a second pay table associated with the secondary game of chance, wherein the second pay table awards a first prize for every player card that satisfies a winning criterion up to and including a first number of calls and subsequent prizes for every player card that satisfies the winning criterion for at least one designated call after the first number of calls and before a second number of calls, wherein the subsequent prizes are different than the first prize, and wherein the winning criterion used for the second pay table in the secondary game of chance is also used for the first pay table in the first game of chance; and a device that concludes the secondary game of chance on or after the second number of calls have been made.

67. The system of claim 66 wherein the device for selecting called objects comprises a random number generator.

68. The system of claim 66 wherein the display comprises a video display.

69. The system of claim 66 wherein the second pay table includes prizes associated with each possible number of matches for all player cards after the second number of calls.

70. The system of claim 66 wherein the second pay table awards the same first prize for every player card that satisfies the winning criterion on a no-split basis.

71. The system of claim 66 wherein the second pay table awards the first prize on a no-split basis.

72. The system of claim 66 wherein the secondary game of chance is bingo and the winning criterion comprises matching a predefined number of objects on a bingo card.

73. The system of claim 66 wherein the secondary game of chance is bingo and the winning criterion comprises matching a predefined pattern of objects on a bingo card.

74. The system of claim 66 wherein the second pay table awards a prize for a plurality of designated calls between the first number of calls and the second number of calls.

75. The system of claim 66 wherein the second pay table awards a prize for even numbered calls between the first number of calls and the second number of calls.

* * * * *